US006585631B1

(12) United States Patent
Hoffman et al.

(10) Patent No.: US 6,585,631 B1
(45) Date of Patent: Jul. 1, 2003

(54) HANGING FILE FOLDER ASSEMBLY APPARATUS AND METHOD

(75) Inventors: William M. Hoffman, Hamilton, OH (US); Murray B. Blumberg, Gauteng (ZA)

(73) Assignee: Stuebing Automatic Machine Company, Cincinnati, OH (US)

( * ) Notice: Subject to any disclaimer, the term of this patent is extended or adjusted under 35 U.S.C. 154(b) by 0 days.

(21) Appl. No.: 09/566,160

(22) Filed: May 5, 2000

(51) Int. Cl.[7] ..... B31B 49/00
(52) U.S. Cl. ..... 493/476; 493/947
(58) Field of Search ..... 493/476, 947, 493/948, 405, 400, 416, 84, 88, 226; 281/45, 51; 40/359; 229/67.2

(56) References Cited

U.S. PATENT DOCUMENTS 3,863,828 A * 2/1975 King
4,830,268 A * 5/1989 Pitts ..... 493/947
4,832,537 A * 5/1989 Roberts et al.
4,854,931 A * 8/1989 Roberts et al. ..... 493/226
5,190,278 A * 3/1993 Wallin et al.
5,261,636 A * 11/1993 Hawes et al. ..... 281/45
5,295,940 A * 3/1994 Fainberg ..... 493/88
5,632,713 A * 5/1997 Canning et al. ..... 493/476
5,876,319 A * 3/1999 Holton ..... 493/84
6,190,298 B1 * 2/2001 Blumberg ..... 493/947

FOREIGN PATENT DOCUMENTS

ZA 87/7373 9/1987

* cited by examiner

*Primary Examiner*—Eugene Kim
*Assistant Examiner*—Sameh Tawfik
(74) *Attorney, Agent, or Firm*—Wood, Herron & Evans, LLP

(57) ABSTRACT

An apparatus for assembling a hanging file folder and method is provided. A folder blank is received at a crimping station whereat a pair of prefabricated suspension rails are each dispensed from a respective hopper to folder a blank. Each one of the pair of suspension rails is dispensed to respective first and second opposed edges of the folder blank. The apparatus is provided with a folder rail dispensing system including plural pneumatically activated actuators for selectively separating a folder rail from a clip of folder rails held within the hopper and reorienting the folder rail into engagement with the folder blank. The folder rail is moved into engagement with the folder blank so as to be located within a gap defined by a hammer bar and an anvil bar, wherein the hammer and anvil bars crimp the prefabricated folder rail upon the folder blank.

20 Claims, 6 Drawing Sheets

HANGING FILE FOLDER ASSEMBLY APPARATUS AND METHOD

FIELD OF THE INVENTION

This invention relates to file folders. More specifically, this invention relates to an improved apparatus and method for assembling hanging file folders.

BACKGROUND

Hanging file folders for filing and holding documents are generally known in the art. Assembly of known file folders has previously required that seven different parts be assembled together by expensive and complex machinery to form the seven parts into a completed hanging file folder. The seven folder parts include (1) a single folder blank, (2 and 3) first and second elongate metal strips for attachment to opposing edges of the file blank and (4, 5, 6 and 7) first and second runners attached to opposed ends of each of the metal strips. In the completed file folder, the elongate metal strips and runners attached to opposed ends of each metal strip are known generally as support elements or support rails.

The prior art machinery is not only a large capital investment, but it is also expensive to maintain. Because the complex machinery has many parts working to assemble seven different parts into a completed file folder, the machinery is more likely to malfunction or break. It generally follows that the more complex a piece of machinery is the more difficult and expensive it is to fix once broken. Malfunctions are more difficult to diagnose and particular parts which must be replaced are also difficult to access within the machinery for replacement.

Finally, prior art machinery for assembling file folders are generally inefficient. It is quite time consuming for known machinery to assemble seven discrete parts into a completed hanging file folder.

OBJECTIVES OF THE INVENTION

It has therefore been an objective of the present invention to provide an improved and more efficient apparatus and method for assembling a hanging file folder.

It has been a further objective of the present invention to provide an improved apparatus and method for assembling hanging file folders that are more simple and reliable than the prior art

SUMMARY OF THE INVENTION

These and other objectives of the present invention are achieved in one embodiment with an improved apparatus and method for assembling hanging file folders in which a substantially planar surface defines a crimping station at which a folder blank having first and second opposing edges is assembled with respective first and second prefabricated folder rails automatically dispensed from first and second rail hoppers, each hopper located adjacent the crimping station proximate the folder blank first and second opposing edges, the first and second prefabricated folder rails being thereafter crimped to respective first and second opposing edges. Each first and second hopper has a folder rail dispensing system in which a series of pneumatically actuated actuators or pins grip, release, hold, lower, reorient, and then push a dispensed folder rail into engagement with respective first and second opposed folder edges. The dispensed folder rail in engagement with the folder blank is crimped between a hammer bar and an anvil bar to permanently secure the file folder rail to the folder blank. First and second embossing drums emboss the file folder substantially medially between the first and second opposed edges to provide an area of flexion for folding the file folder approximately in half longitudinally.

In use, a conveyor transports the folder blank to the crimping station where a sensor detects the leading edge of the folder blank. A stop or barrier is provided to engage the leading edge of the folder blank in order to register the folder blank at the crimping location. The folder blank is registered at the crimping station between the first and second hoppers proximate the first and second opposing edges, respectively. A clip of prefabricated folder rails having a leading or bottom-most rail is retained in each first and second hopper. Each first and second hopper dispensing system selectively releases the leading or bottom-most folder rail from the clip and moves the rail into engagement with respective first and second opposed folder edges.

In one aspect of a preferred dispensing system, a first pin grips the clip of rails within the hopper to prevent multiple folder clips from being dispensed at the same time. The leading or bottom-most rail is free from the first pin and rests upon a second pin within the hopper, ready to be dispensed. A third pin, which is preferably magnetic, securely engages the bottom-most rail and the second pin is withdrawn to allow the third pin to lower the bottom-most rail away from the clip. One or more cradles attached to a fourth pin or actuator catches the rail as it is released from the third pin. The fourth pin reorients the rail to allow a fifth pin to push the rail into engagement with the folder blank edge. The rail is then crimped upon the folder blank between the hammer and anvil.

Thus, the present inventive apparatus and method for forming a hanging file folder greatly reduces the complexity of prior art file folder assembly systems. In particular, the present inventive apparatus and method simply assembles three modular parts, i.e., (1) a folder blank and (2 and 3) a pair of prefabricated folder rails, rather than prior art systems which must assemble seven discrete parts. The present inventive apparatus and method also provides cost savings over prior art apparatus which are more complex and represent, as a result, greater complexity if repair of that prior art apparatus is required.

BRIEF DESCRIPTION OF THE FIGURES

The objectives and features of the invention will become more readily apparent from the following detailed description taken in conjunction with the accompanying drawings in which.

DETAILED DESCRIPTION OF THE PREFERRED EMBODIMENT

Figure 1:
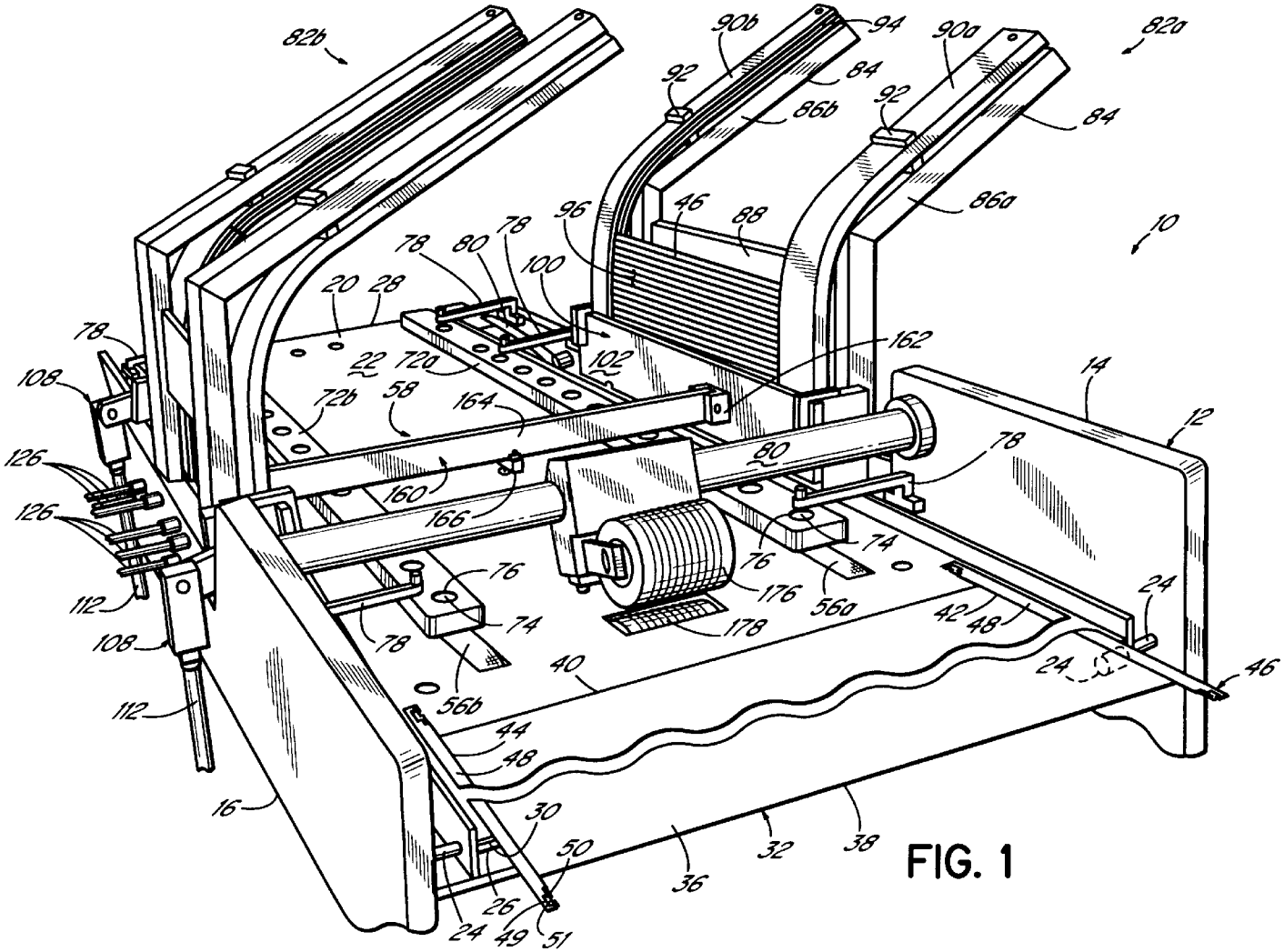
FIG. 1 is a perspective view of a presently preferred embodiment of the folder assembly apparatus according to the principles of the present invention.

A presently preferred embodiment of the present inventive hanging file folder assembly apparatus 10 is seen in FIGS. 1–4. The apparatus 10 has a frame 12 with first and second spaced frame sides 14, 16 supported by leveling feet 18. A table top 20 having a substantially planar surface 22 is connected to the first and second sides 14, 16 with screws 24 threaded into adjusting sleeves 26. The apparatus 10 has an insertion end 28 and a dispensing end 30 defining a machine direction represented by arrow MD in which assembly of a hanging file folder 32 proceeds. A user operates the apparatus 10 via a control panel 34 located at the insertion end 28.

The hanging file folder 32 assembled by the present inventive apparatus 10 and method includes a folder blank 36 having a leading edge 38 and a trailing edge 40 defining a blank width, and first and second opposed edges 42, 44 defining a blank length. The hanging file folder 32 also includes a pair of prefabricated suspension rails 46, each rail 46 securely crimped to respective first and second opposed edges 42, 44. The prefabricated suspension rail 46 as described herein is the subject of Republic of South Africa Patent No. 87/7373, incorporated by reference herein in its entirety. Generally, the prefabricated suspension rail 46 includes a generally U-shaped elongate metal strip 48 having opposed ends. Preferably, plastic suspension runners 50 are secured to respective opposed ends of the elongate metal strip 48. Each end of the metal strip 48 has a notch 49 and the associated runner 50 likewise has a notch 51. The notches 49, 51 are conviently used to suspend the hanging file folder 32 and its contents on suspension bars (not shown) in a desk drawer or the like as is well known in the art.

In a first aspect of the present inventive apparatus 10, a feed tray 52 is supported by a tray mounting bracket **52*a* attached by any suitable means to the table top 20 to allow a user to manually insert the folder blank 36 into the apparatus 10. A hold tray 53 is attached by any suitable means to the dispensing end 30 of the apparatus 10 to receive the completed file folder 32. The apparatus 10 includes a conveyor 54 with first and second conveyor belts 56*a*, 56*b* to convey the folder blank 36 to a crimping station 58 defined by the table top 20 and having dimensions substantially similar to the folder blank 36 where prefabricated folder rails 46 are secured to the first and second opposed edges 42, 44. The conveyor 54 is driven by a motor 60 attached to the frame 12 by a mounting bracket 62. The motor 60 has a first sprocket 64 which drives a first drive chain 66 looped around an idler sprocket 65 which is provided with a second drive chain 67 looped around the idler sprocket 65 and a conveyor drive shaft 68. Each of the first and second conveyor belts 56*a*, 56*b* are looped around the conveyor drive shaft 68 proximate the discharge end 30 and an idler shaft 70 proximate the insert end 28**.

First and second ball conveyor rails **72*a*, 72*b* are provided for respective first and second conveyor belts 56*a*, 56*b* to provide sufficient frictional engagement between the folder blank 36 and the conveyor 54 to transport the folder blank 36 to the crimping station 58. Each of the first and second ball conveyor rails 72*a*, 72*b* define plural sockets 74, each socket 74 holding a clamp ball 76 which frictionally engages the folder blank 36 and rolls counter to the machine direction MD as the folder blank 36 is transported to the crimping station 58. Each first and second conveyor rail 72*a*, 72*b* is supported over respective first and second belts 56*a*, 56*b* by multiple conveyor rail brackets 78 attached to the first and second conveyor rails 72*a*, 72*b* and first and second frame sides 14, 16 by any suitable means. To aid proper registration of the folder blank 36 into engagement with the conveyor 54, a hold-down lever 80 is attached by any suitable means to the first and second frame sides 14, 16 proximate the insertion end 28 between first and second conveyor rails 72*a*, 72*b* and respective first and second frame sides 14, 16**.

As best seen in FIG. 1, the apparatus 10 is provided with first and second hoppers **82*a*, 82*b* located on opposite sides of the apparatus 10 at the crimping station 58 and which are adapted to dispense a prefabricated suspension rail 46 to the folder blank first and second opposed edges 42, 44 when located at the crimping station 58. Description of the first and second hoppers 82*a*, 82*b* will be herein limited to the first hopper 82*a*, however, it will be understood that the second hopper is substantially identical in structure. The first hopper 82*a* includes a hopper frame 84 with first and second frame legs 86*a*, 86*b* secured together and spaced apart with a tie-bar 88. First and second hopper rails 90*a*, 90*b* are attached to respective first and second hopper legs 86*a*, 86*b* with a clamp bar 92, each hopper rail 90*a*, 90*b* defining a clip slot 94 to provide registration for a clip of prefabricated suspension rails 96 inserted therein. The first hopper 82*a* is attached to the table top 20** by any suitable means.

As best seen in FIGS. 2A–2E, the apparatus 10 has a crimper 100 provided proximate the first hopper **82*a* for securing a prefabricated suspension rail 46 to the folder blank 36. The crimper 100 includes a hammer bar 102 and an anvil bar 104 defining a gap 106 therebetween, one of the opposed edges 42, 44 of the folder blank 36 is registered at the crimping station 58 within the respective gap 106 where a prefabricated suspension rail 46 is positioned into engagement with the folder blank 36 within the gap 106 so that the hammer bar 102 may drop against the prefabricated suspension rail 46, crimping it upon the folder blank 36 against the anvil bar 104. The hammer bar 102 is actuated by a hammer bar lever 108 pivotally attached to a cam drive assembly 110 including a cam arm 112 linked to a cam drive shaft 114. The cam drive shaft 114 is driven by the motor 60 and linked thereto via a gear box 116 with third chain 118 looped around a gear box sprocket 120 and a clutch sprocket 19*a* on a clutch 119. A fourth chain 121 is looped from the clutch sprocket 119*a* around a second sprocket 121*a* provided on the motor 60**.

Figure 2A:
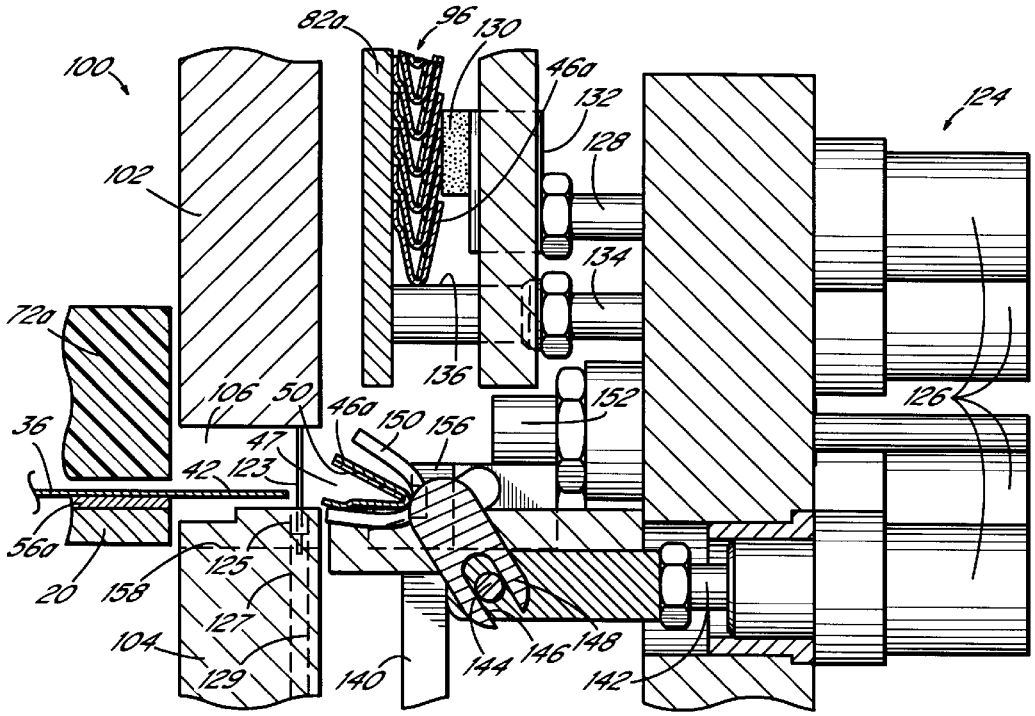
FIG. 2A is a cross sectional view of FIG. 1 taken along line 2—2 of FIG. 1, showing a first step in a presently preferred method of assembling a file folder in accordance with the principles of the present invention.

To ensure that the folder blank 36 is properly registered at the crimping station 58, a crimping station guide, i.e., retractable blade 123, may be raised from a channel 125 defined in the anvil bar 104. As seen in FIG. 2A, the retractable blade 123 is raised from the channel 125 to be located within the gap 106 proximate hammer bar 102 as the folder blank 36 is being located at the crimping station 58. The retractable blade 123 is held by a pair of pins 127 (only one shown), each journaled in a bore 129 defined in the anvil bar 104. Each pin 127 is attached to a piston rod (not shown) actuated by an air cylinder (not shown) attached to the anvil bar 104 by any suitable means. Prior to engaging the bottom-most rail **46*a* with the folder blank 36, the retractable blade 123 is retracted within the channel 125 flush with the anvil bar 104. After the bottom-most rail 46*a* has been crimped to the folder blank 36 and the file folder 32 is discharged from the apparatus 10, the retractable blade 123** is again raised into position within the gap 106 to guide another folder blank to the crimping station 58.

The clip of prefabricated suspension rails 96 fed into the first hopper 82*a* includes plural nested prefabricated suspension rails 46 with a leading or bottom-most rail 46*a*. The apparatus 10 is provided with a rail dispensing system 124 which selectively releases the bottom-most rail 46*a* to be reoriented into engagement with the folder blank 36. In one aspect of the presently preferred embodiment, the dispensing system 124 has a number of actuators, each of which is pneumatically driven by one of the plural air cylinders 126 linked to a source of pressurized air (not shown).

Figure 2B:
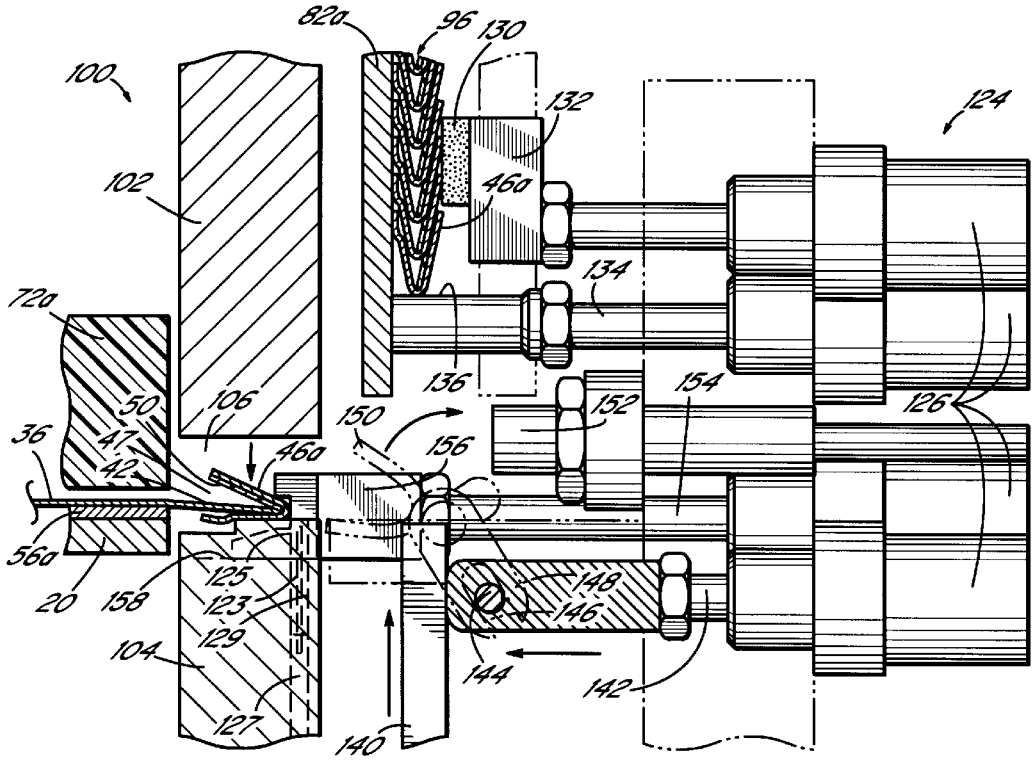
FIG. 2B is a view similar to FIG. 2A of a second step in the method.
Figure 2C:
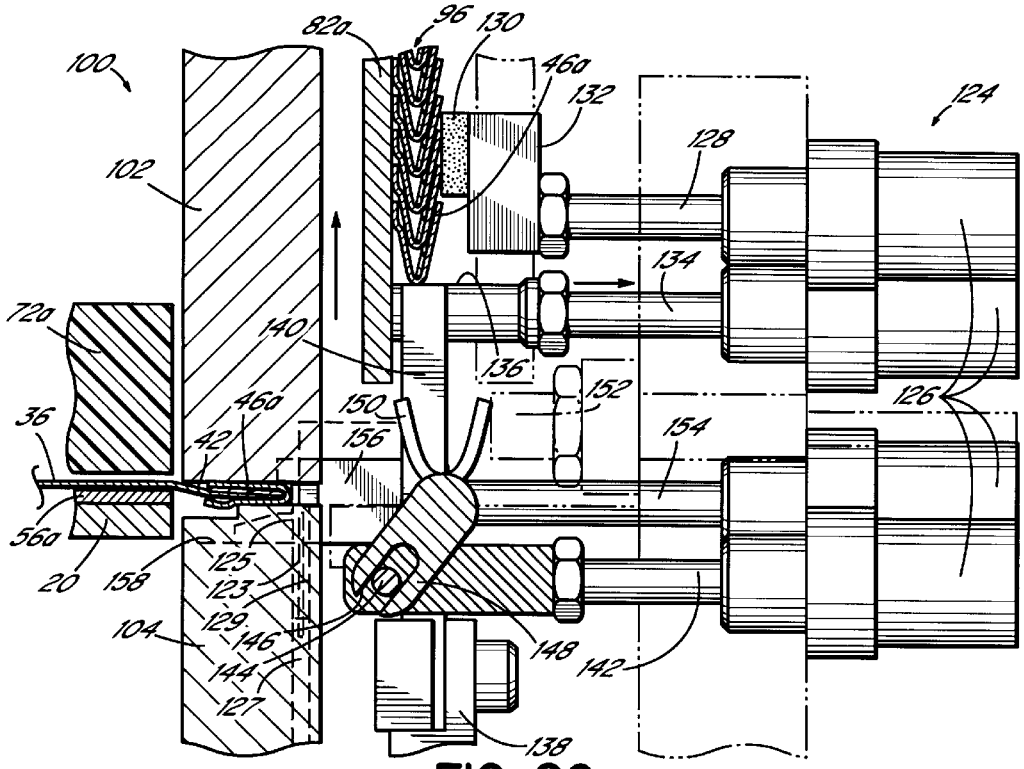
FIG. 2C is a similar view to FIG. 2A of a third step in the method.
Figure 2D:
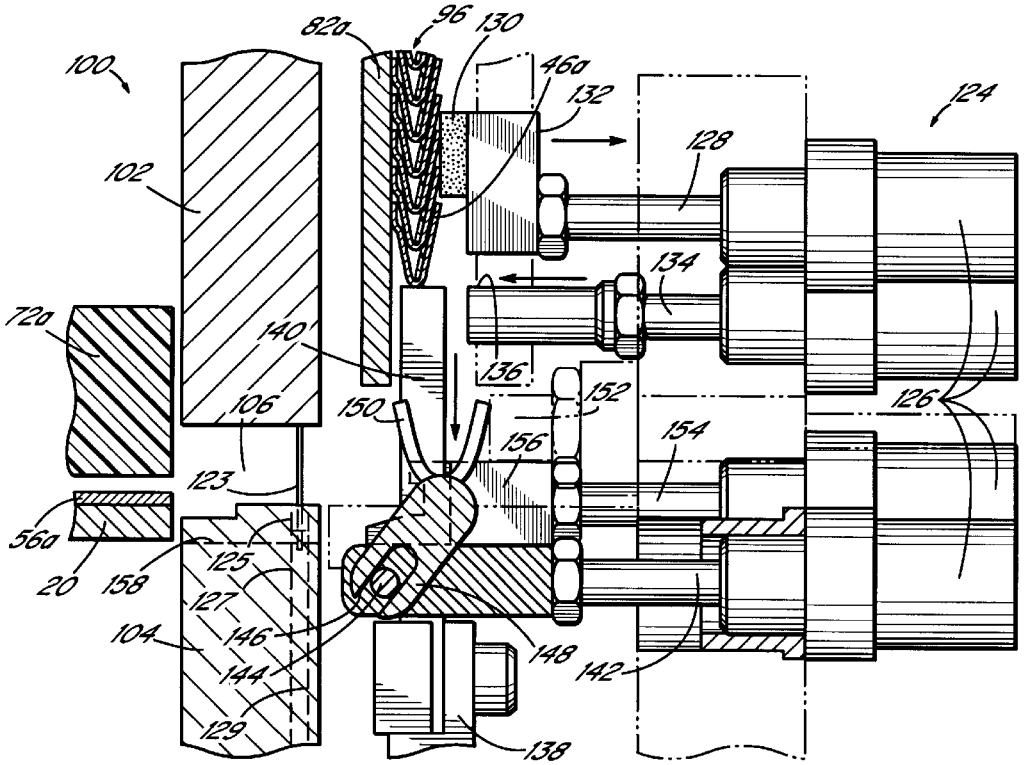
FIG. 2D is a similar view to FIG. 2A of a fourth step in the method.
Figure 2E:
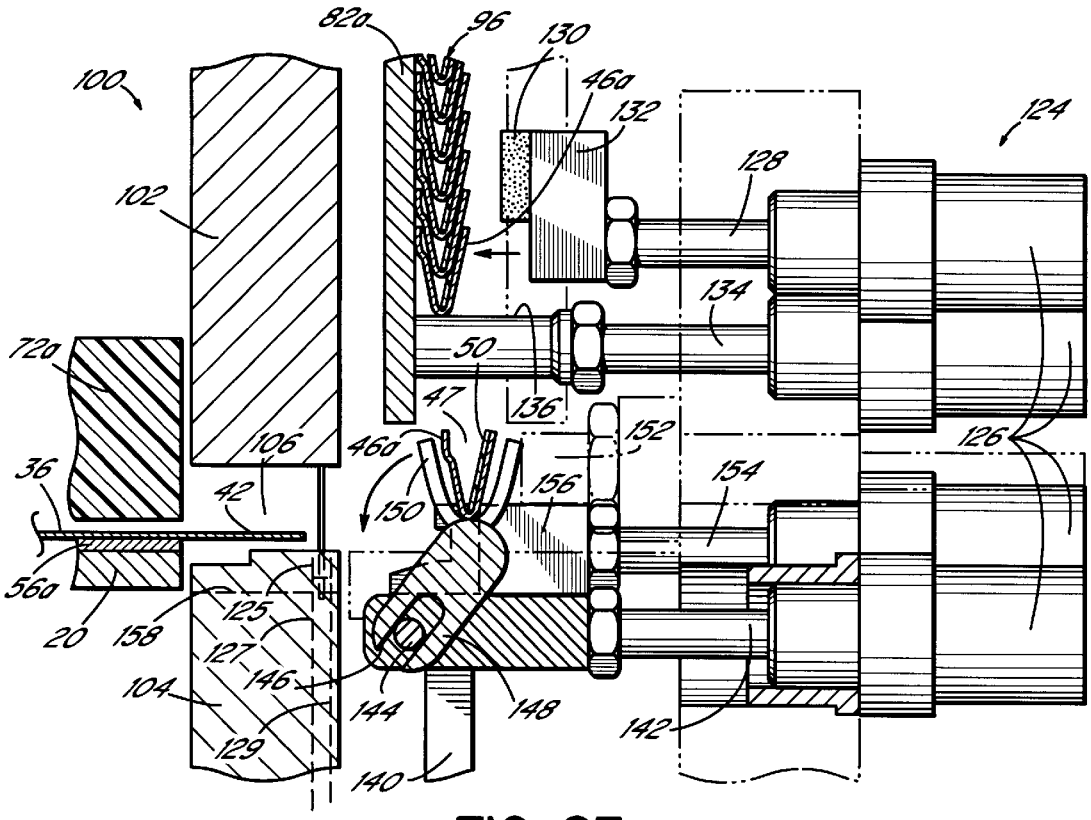
FIG. 2E is a similar view to FIG. 2A of a fifth step in the method.
Figure 3:
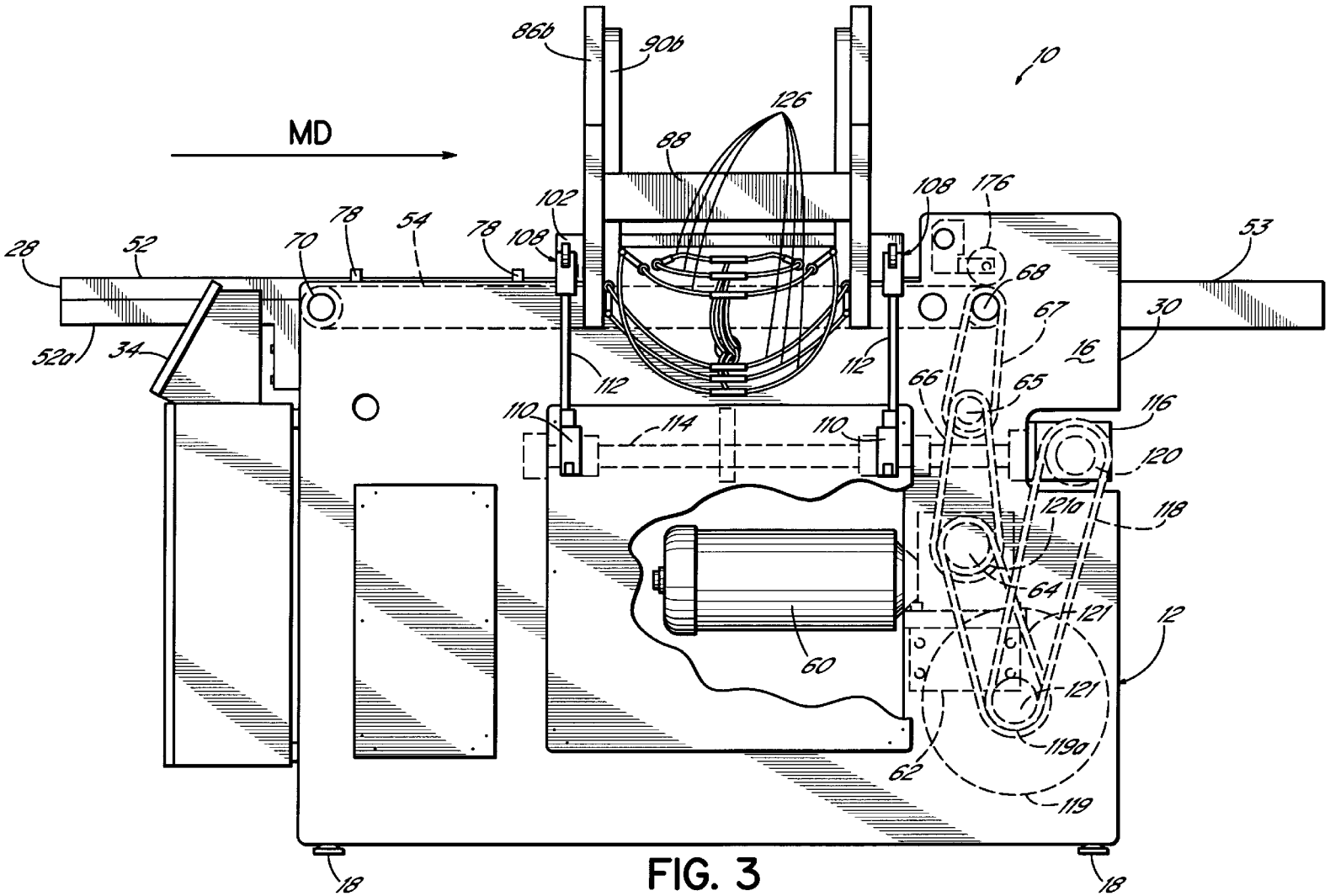
FIG. 3 is a broken away side plan view of the apparatus of FIG. 1.
Figure 4:
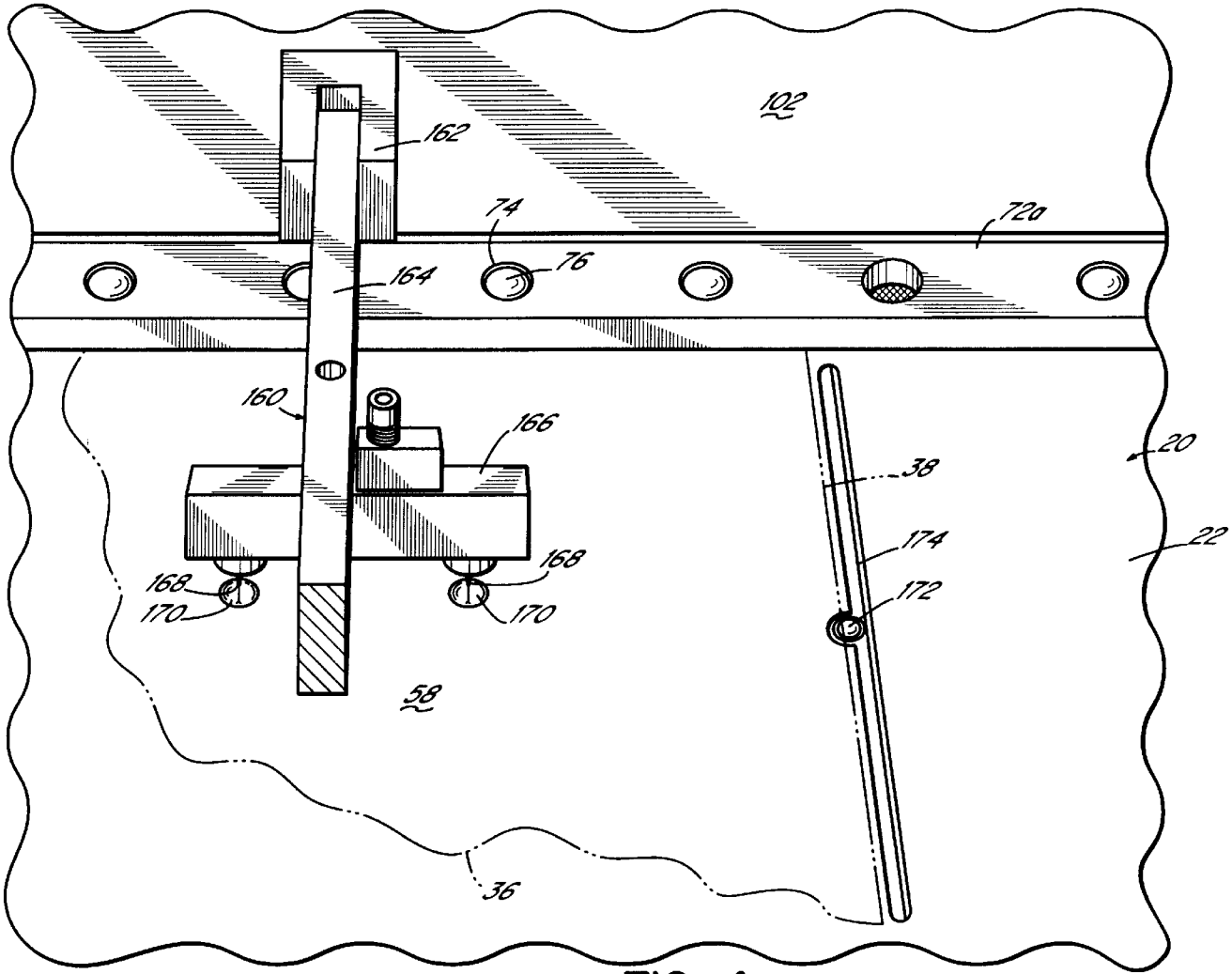
FIG. 4 is a broken away view of a cutting system and registration system in accordance with the principles of the present invention.

The dispensing system 124 has a first actuator or pin 128 driven by an air cylinder 126 for maintaining the clip of rails 96 in a generally vertical orientation within the first hopper 82*a*. The first pin 128 includes a pad 130 attached to the pin 128 by a pad shoe 132. When the first pin 128 is extended by the air cylinder 126, the pad 130 frictionally holds the clip of rails 96, with the exception of the leading rail 46*a* within the first hopper 82*a* as shown in FIGS. 2A and 2B. In one aspect of the resent invention, the pad 130 is advantageously formed from relatively soft material, e.g., natural or synthetic rubber to create sufficient frictional engagement between the pad 130 and the clip of rails 96.

The dispensing system has a second pin 134 which provides a resting surface 136 upon which the bottom-most rail 46*a* rests prior to being dispensed from the first hopper 82*a*. When the second pin 134 is retracted, the bottom-most rail 46*a* is released from the clip of rails 96 and is engaged and maintained in generally upright orientation with a mouth 47 of the rail 46*a* being upwardly open or held in a vertical orientation by a third pin 138. In another aspect of the present invention, the third pin 18 is provided with a magnet 140 to securely hold the bottom-most rail 46*a* released by the second pin 134 in general vertical orientation. The dispensing system 124 includes a fourth pin 142 having a cam pin 144 journaled in a cam slot 146 defined in a pull cam 148 provided with a pair of spaced generally vertically oriented cradles 150, when the fourth pin 142 is extended as in FIG. 2*d*. The cradles 150 receive the bottom-most rail 46*a* as the third pin 138 is retracted, thereby disengaging the bottom-most rail 46*a* from the magnet 140. A pair of proximity sensors 152 sense whether the bottom-most rail 46*a* has been successfully released by the third pin 138 into the cradles 150.

As the fourth pin 142 retracts, the generally vertically oriented bottom-most rail 46*a* is reoriented to a generally horizontal position. A fifth pin 154 is provided with a guide member 156 which is extended to engage the generally horizontally oriented bottom-most rail 46*a* and push the bottom-most rail 46*a* into the gap 106 defined by the hammer bar 102 and the anvil bar 104, and into engagement with the folder blank 36. As such, the edge 42 or 44 is positioned within the mouth 97 of the rail 46*a*. The anvil bar 104 defines a recessed portion 158 which receives the guide member 156 as the bottom-most rail 46*a* is pushed into engagement with the folder blank 36.

A folder punch assembly 160 is linked to the hammer bar 102 and is actuated to punch holes (not shown) in the folder blank 36 when the bottom-most prefabricated folder rail 46*a* is crimped upon the folder blank 36. The folder punch assembly 160 includes a punch mounting bracket 162 linking a punch mounting bar 164 to the hammer bar 102. A cutter bar 166 is attached by any suitable means to the punch mounting bar 164 and includes a pair of punch blades 168 which are received within respective punch die pins 170 when the hammer bar 102 is actuated. The holes formed in the folder blank 36 by the punch blades 168 are adapted to receive a prong fastener (not shown) known in the art to facilitate securing documents within the hanging file folder 32.

To properly register the folder blank 36 at the crimping station 58, the leading edge 38 of the folder blank 36 is detected by a sensor 172 recessed within the table top 20. When the leading edge 38 of the folder blank 36 is detected by the sensor 172, the sensor 172 triggers a stop or barrier 174 recessed within the table top 20 to be raised and intercept the leading edge 38 to arrest the folder blank 36 at the crimping station 58.

In another aspect of the present inventive apparatus, first and second mating embossing rolls 176, 178 are provided on a mounting shaft 180 to emboss the folder blank 36 approximately medially between the first and second opposed edges 42, 44 as the folder blank 36 with the prefabricated folder rails 46 secured thereto is discharged from the crimping station 58.

In the preferred method of use, a user inserts a folder blank 36 into the feed tray 52 and engages the folder blank 36 with the conveyor 54 to convey the folder blank 36 to the crimping station 58. The folder blank 36 is positioned in proper registration at the crimping station 58 as the leading edge 38 engages the sensor 172 which actuates the barrier 174 to be raised and engage the leading edge 38. Each of the clips of prefabricated rails 96 is formed and inserted substantially vertically on each of the first and second hoppers 82*a*, 82*b*. Each clip of rails 96 is frictionally held within the hoppers 82*a*, 82*b* by the first pin 128, the bottom-most rail 46*a* resting upon the extended second pin 134. The second pin 134 releases the bottom-most rail 46*a* from the clip of rails 96 and the third pin 138 is extended to engage and lower the bottom-most rail away from the clip of rails 96. The third pin 138 lowers the substantially vertically oriented bottom-most rail 46*a* into engagement with the cradles 150 and the proximity sensors 152*a*, 152*b* sense whether the bottom-most rail 46*a* has been successfully caught within the cradles 150. Once the third pin 138 has retracted, the fourth pin 142 retracts, thereby reorienting the bottom-most rail 46*a* from the substantially vertical orientation to the substantially horizontal orientation. The fifth pin 154 is actuated to extend and push the bottom-most rail 46*a* into engagement with the respective first and second opposing edge 42, 44 of the folder blank 36. When the bottom-most rail 46*a* has been pushed into engagement with the folder blank 36, the hammer bar 102 is dropped upon the bottom-most rail 46*a*, thereby crimping it securely upon the folder blank 36 against the anvil bar 104. Simultaneously, the punch assembly 160 cuts a pair of holes in the folder blank 36. After the bottom-most rail 46*a* has been successfully secured to the folder blank 36, the barrier 174 is retracted and the conveyor 54 is actuated to discharge the file folder 32 from the apparatus 10. As the file folder 32 is discharged from the apparatus 10, the first and second embossing rolls 176, 178 emboss the file folder 32 substantially medially between the first and second opposed edges 42, 44 to provide a weakened area at which the file folder 32 may be folded.

From the above disclosure of the detailed description of a presently preferred embodiment of the present invention and the preceding summary of the preferred embodiment, those skilled in the art will comprehend the various modification to which the present invention is susceptible. Therefore, we desire to be limited only by the scope of the following claims and equivalents thereof.

We claim:

1. A method of assembling a file folder having a folder blank with a leading edge width and first and second opposing edges, comprising the step of:

positioning the folder blank at a crimping station;

vertically orienting a pre-fabricated folder rail in a hopper adjacent one of the first and second opposing edges at said crimping station;

dispensing said pre-fabricated folder rail from said hopper;

reorienting said folder rail substantially horizontally to allow engagement with one of the opposing edges of the folder blank;

engaging said folder rail with one of the opposing edges of the folder blank; and crimping said rail into secure engagement with one of the opposing edges of the folder blank.

2. The method of claim 1, comprising the step of embossing the folder blank approximately medially between the first and second opposing edges.

3. The method of claim 1, comprising the step of engaging the leading edge to register the folder blank at said crimping station.

4. The method of claim 1, comprising the steps of vertically orienting, dispensing, re-orienting, engaging and crimping a first and a second pre-fabricated folder rail on the first and second opposing edges, respectively.

5. The method of claim 4 wherein the first and second folder rails are dispensed, re-oriented, engaged and crimped generally simultaneously onto the first and second opposing edges, respectively.

6. The method of claim 1, comprising the step of guiding the folder blank into said crimping station.

7. The method of claim 1, wherein the rail is crimped into secure engagement along substantially the entire length of one of the opposing edges of the folder blank.

8. An apparatus for assembling file folders having a folder blank with a leading edge and first and second opposing edges and first and second prefabricated folder rails, each with an elongate metal strip and a pair of runners secured to opposite ends of the metal strip, comprising:

a crimping station adapted to receive the folder blank;

a hopper containing a plurality of prefabricated folder rails adjacent said crimping station;

a dispensing system coupled to said hopper and adapted to dispense the prefabricated folder rails therefrom; and a crimper adapted to secure individual prefabricated folder rails into the opposing edges of the folder blank.

9. The apparatus of claim 8, comprising a conveyor having a machine direction adapted to transport the folder blank in said machine direction to said crimping station.

10. The apparatus of claim 8, comprising a station guide adapted to register the folder blank within said crimping station.

11. The apparatus of claim 8, comprising a sensor adapted to sense the leading edge of the folder blank positioned at said crimping station.

12. The apparatus of claim 8, comprising a barrier adapted to engage the leading edge of said folder blank, wherein said barrier is adapted to register said folder blank at said crimping station.

13. The apparatus of claim 8, comprising:

an embosser adapted to emboss the folder blank approximately medially between the first and second opposing edges.

14. The apparatus of claim 8, comprising plural selectively movable hopper actuators adapted to selectively dispense the folder rail from the hopper.

15. The apparatus of claim 14, comprising:

a first actuator adapted to hold a clip of plural prefabricated folder rails within said hopper, said clip having a leading rail;

a second actuator adapted to retain the clip with the exception of said leading rail of said clip;

a third actuator adapted to separate said leading rail from said clip;

a fourth actuator adapted to receive said leading rail from said third actuator, wherein said fourth actuator is adapted to reorient said leading rail from a substantially vertical orientation toward a substantially horizontal orientation; and a fifth actuator adapted to position said leading rail into engagement with the folder blank.

16. The apparatus of claim 8, wherein the at least one crimper is adapted to secure substantially the entire edge of the folder blank between the sidewalls of the associated rail.

17. A method of assembling a file folder from a folder blank having first and second opposing edges and at least one elongate, prefabricated folder rail having first and second opposing sidewalls, comprising:

positioning the folder blank at a crimping station;

vertically orienting the folder rail in a hopper proximate the crimping station and adjacent one of the first and second opposing edges;

dispensing the folder rail from the hopper;

reorienting the folder rail substantially horizontally so that one of the first and second edges of the folder blank may be received between the first and second sidewalls of the folder rail;

engaging the folder rail with the edge of the folder blank, lengthwise along the edge; and crimping the edge of the folder blank between the first and second sidewalls of the folder rail.

18. The method of claim 17, wherein the folder rail is crimped along substantially the entire length of the opposing edges of the folder blank.

19. An apparatus for assembling file folders from a folder blank having first and second opposing edges, the apparatus comprising:

a crimping station adapted to receive the folder blank;

at least one hopper adjacent said crimping station and containing a plurality of elongate, prefabricated folder rails, said folder rails including first and second opposing sidewalls;

a dispensing system coupled to said hopper and adapted to dispense said folder rails therefrom; and at least one crimper adapted to secure the one of the first an second edges of the folder blank between said first and second sidewalls of said folder rail.

20. The apparatus of claim 19, wherein the at least one crimper is adapted to secure substantially the entire edge of the folder blank between the sidewalls of the associated rail.

* * * * *

UNITED STATES PATENT AND TRADEMARK OFFICE

CERTIFICATE OF CORRECTION

PATENT NO. : 6,585,631 B1 
DATED : July 1, 2003
INVENTOR(S) : William M. Hoffman and Murray B. Blumberg It is certified that error appears in the above-identified patent and that said Letters Patent is hereby corrected as shown below:

Column 4,
Line 47, "clutch sprocket 19a" should read -- clutch sprocket 119a --.

Column 5,
Line 21, "of the resent invention" should read -- of the present invention --.
Line 34, "the third pin 18 is" should read -- the third pin 138 is --.

Column 7,
Line 51, "into" should read -- onto --.

Signed and Sealed this

Sixteenth Day of September, 2003

JAMES E. ROGAN
*Director of the United States Patent and Trademark Office*